United States Patent [19]

Koike

[11] 4,012,926

[45] Mar. 22, 1977

[54] CAM CARRIAGE IN DUAL-BED HAND KNITTING MACHINE

[76] Inventor: Fuji Koike, 2006-143 Aza-Sakaine Oaza-Minami, Tempaku-cho, Showa, Nagoya, Aichi, Japan

[22] Filed: May 19, 1976

[21] Appl. No.: 687,864

[30] Foreign Application Priority Data

| | | |
|---|---|---|
| June 24, 1975 | Japan | 50-78239 |
| June 24, 1975 | Japan | 50-78240 |
| June 24, 1975 | Japan | 50-87369[U] |
| June 24, 1975 | Japan | 50-78241 |

[52] U.S. Cl. ..... 66/63

[51] Int. Cl.[2] ..... D04B 7/06

[58] Field of Search ..... 66/60, 64, 60 H, 64 H, 66/78, 66, 72, 63

[56] References Cited

UNITED STATES PATENTS

| | | | |
|---|---|---|---|
| 1,994,653 | 3/1935 | Korber | 66/63 |
| 2,043,286 | 6/1936 | Diem | 66/63 |
| 2,219,607 | 10/1940 | Zimic | 66/63 |
| 3,451,229 | 6/1969 | Matsui | 66/66 X |

FOREIGN PATENTS OR APPLICATIONS

| | | | |
|---|---|---|---|
| 1,155,559 | 10/1963 | Germany | 66/60 H |
| 586,929 | 12/1958 | Italy | 66/63 |
| 46-15144 | 4/1971 | Japan | 66/66 |

*Primary Examiner*—Ronald Feldbaum
*Attorney, Agent, or Firm*—Birch, Stewart, Kolasch and Birch

[57] ABSTRACT

The invention provides an improved cam carriage in dual-bed hand knitting machine for pearl knitting. The cam carriage is adapted to be manually transversely reciprocated astride and along said two beds so that a plurality of double hook latch needles arranged in the respective grooves are subjected to so-called knitting wave movement. Either of the opposite hooks is adapted to engage with the cam plates directly so as to vertically move the needle in and along the needle groove whereby the opposite side hook is subjected to the knitting operation. Such hand knitting machine having such cam carriage has been in public knowledge. The invention improves the cam arrangement and provides some means arranged in relation to said particular cam arrangement for ensuring smooth movement of the carriage and clearing and/or closing of the latches.

8 Claims, 10 Drawing Figures

CAM CARRIAGE IN DUAL-BED HAND KNITTING MACHINE

The present invention relates generally to dual-bed hand knitting machines for pearl knitting, and more particularly to a transversely reciprocating cam carriage astride and along the two needle beds for actuating a plurality of double hook latch needles so as to each vertically reciprocate between stitch-forming and latch-clearing positions in the concerned needle groove across the both needle beds.

In the pearl knitting machine, which is also called the garter knitting machine, of the type as referred to above, there are provided a pair of substantially rectangular-shaped needle beds arranged opposedly and spacedly in a horizontal plane. Each transversely extending needle bed is provided with a plurality of vertical needle grooves so that each of said grooves formed in the forward bed is in alignment with each corresponding groove of the rearward bed.

It has been in public knowledge to design such knitting machine in such a way that when the cam carriage is manually moved along the two needle beds, each of the double hook latch needles arranged in the respective grooves is engaged at either of the hooks thereof directly, namely without using any intermediate means such as jacks, with the cams formed on the reverse side of the carriage for causing said vertical reciprocating movement of the needle. Depending on the cam arrangement, a plurality of double hook needles are subjected to knitting wave movement so that the hook of the needle at the opposite side may forwardly and rearwardly be moved between said stitch-forming and latch-clearing positions along the needle groove.

In said known hand knitting machine, a yarn feeder is positioned just at the center of the cam carriage so that it passes along a transverse center line of the transversely elongated space gap formed between the parallelly and opposedly arranged two needle beds, as the cam carriage is slidingly moved astride said two beds. The cam arrangement and consequently needle passages defined by a plurality of cam plates are to be symmetrical either vertically or transversely in respect of said central yarn feeder. When manually moving the cam carriage, there are caused so-called moving waves for knitting of the needles. The transverse movement of the cam carriage relative to the needles, which are still so far as the transverse direction is concerned, may be considered, for the convenience of understanding, as if a plurality of needles successively enter the cam carriage, which is supposedly stands still, from one side thereof to go through the passage defined by the cam plates with engaging of each latch cleared hook with and along the cam edge and leave out of the cam carriage at the other side thereof.

There are to be four entrances into and consquently four exits out of the cam arrangement for the cam engaging hook of the double ended needle, in the hand knitting machine of the type as referred to above. When the needle is brought into the territory of the cam carriage with the cam engaging hook, of which latch concerned is cleared, entering the cam arrangement from any of said entrances, the other side hook must be subjected to "latch-over" movement in which the needle is moved a little forwardly, i.e. toward the opposedly arranged needle bed so as to transfer yarn loop already received in the latch closed hook over the latch onto the needle shank, and to "yarn receiving" movement in which the latch cleared hook is positioned below the yarn feeder to receive new supply of yarn, and then to "knock-over" movement in which the needle is considerably moved rearwardly, i.e. away from the opposite needle bed so that the latch closed hook forms stitch. The needle passages, or more strictly speaking the passages for cam engaging hooks, in the cam arrangement of either of the base members may thus be considered to consist of the latch-over needle passage, yarn receiving needle passage and knock-over needle passage corresponding to the movements of the opposite hook for knitting operation as referred to above.

It is appreciated that every latch on the cam engaging side of the needles must be cleared or opened before entering any of said passages from the concerned entrance, and every latch on the knitting operation side of the needles must timingly be cleared and closed, respectively reliably and without fail. Otherwise the cam carriage can not smoothly and rapidly be operated in view of eventual abutting of any part of the cam carriage on the closed latch of the needle. When the manual actuation force applied onto the cam carriage is strong, the needle or the cam carriage is inevitably damaged. In fact the conventional hand knitting machines of said type have not been satisfactory in these matters.

A principal object of the invention is thus to provide a hand knitting machine of the type as above having a very simple construction of the cam arrangement and concerned members with perfectly avoiding such troubles and ensuring smooth and rapid operation of the cam carriage.

Said object and other objects to be readily appreciated by studying the detailed explanation of a preferred embodiment in reference to the accompanying drawings can be attained according to the invention by providing a particular cam arrangement for producing the latch-over, yarn receiving and knock-over passages as well as some associated members for clearing and closing every latch of the needle in relation to said passages as set forth in the claims.

FIG. 1 is a plan view of the hand knitting machine according to the invention but in which there is seen no particular features of the invention, FIG. 2 is a plan view of the reverse side of the cam carriage in an enlarged scale, together with four double hook latch needles, each arranged at the four entrances into the cam carriage, FIGS. 3A and 3B are respectively a perspective view of a detachable independent cam member for moving the needle having left out of a passage of either of the opposed cam arrangement base members toward the opposite base member to enter the passage thereof, and a plan view of said cam member detachably mounted to a cam carriage shown only in part;

Figure 7:
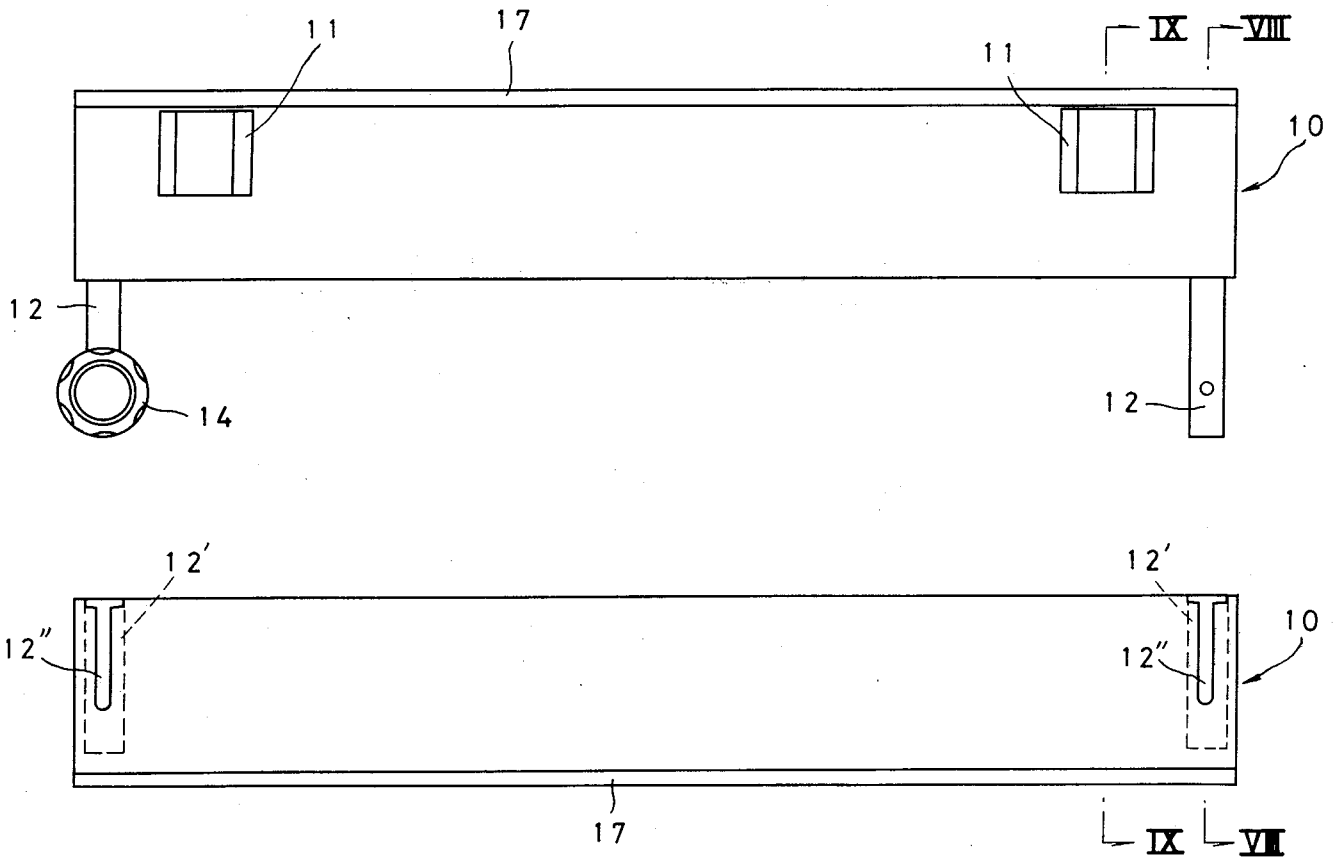
FIG. 7 is a bottom plan view of the needle beds separated with each other for showing an additional preferable feature of the invention.
Figure 8:
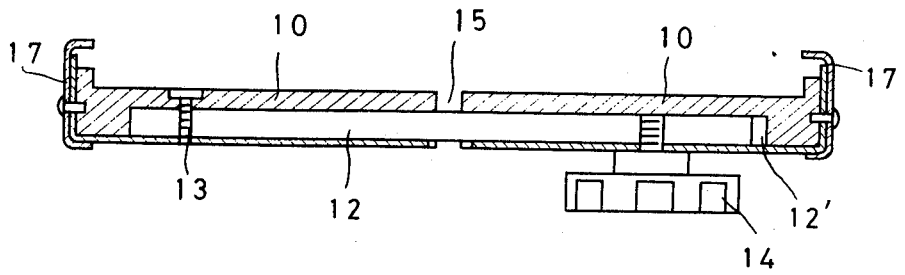
FIG. 8 is a sectional view taken along the line VIII—VIII in FIG. 7.
Figure 9:
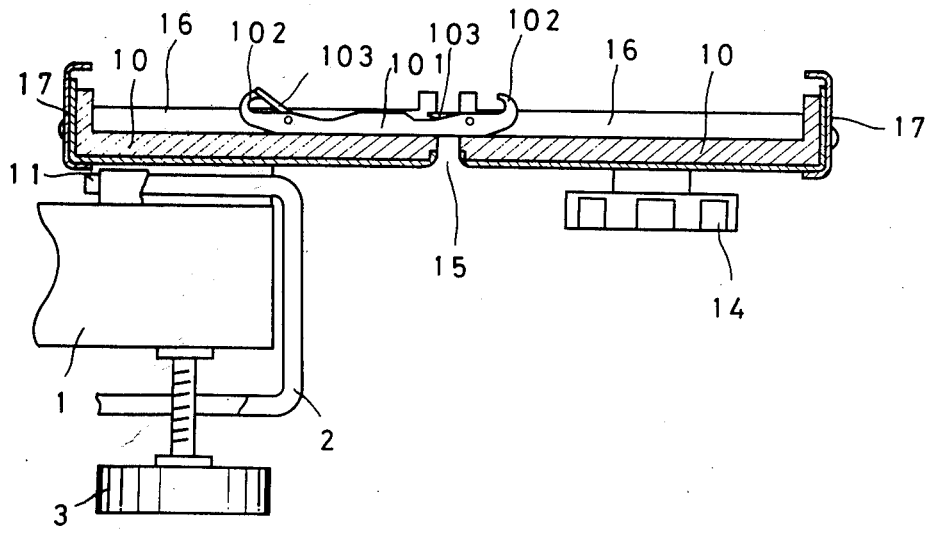
FIG. 9 is a sectional view taken along the line IX—IX in FIG. 7.

There are shown in FIGS. 1, 7, 8 and 9 a pair of substantially rectangular shaped needle beds represented generally by reference numerals 10, 10. It is preferable to amount suitable metal fittings 11, 11 fixedly onto the bottom of the forward needle bed for facilitating to set up the knitting device onto a work desk 1 as best shown in FIGS. 7 and 9. There are provided two vertically elongated connectors 12, 12 which are respectively fixed 13 at one end thereof to the forward needle bed at the bottom. The other end of each connector 12 is fitted in a reception member 12′ provided on the rearward needle bed 10 which is fixedly positioned relative to the forward needle bed 10 with leaving a determined narrow space gap therebetween. As best shown in FIG. 7, there is preferably provided a slot 12′ so as to allow insertion of a screwed stud (not shown) fixed to a knob 14. When the knob 14 is manually turned, the separate beds 10, 10 can be readily fixed together or said beds readily separated.

There are formed a plurality of vertical needle grooves 16 on each of the transversely extending beds 10, 10 so that the corresponding grooves of the forward and rearward beds are in alignment. Along the transverse outer sides of the opposed beds 10, 10, there are provided a pair of rails 17, 17 for smoothly guiding the transverse movement of a cam carriage represented generally by reference numeral 20 which comprises two transversely elongated rectangular portions 21, 21 each having cam arrangement for the respective needle bed 10 on the reverse side thereof, and a vertical connector portion 22 on which is mounted a handle knob 23 so as to manually move said cam arrangement portions as a single carriage. At the center of the cam carriage 20, there is provided a yarn feeder 24 so that it passes along a transverse center line of the space gap 15, as the carriage 20 is moved along the needle beds 10, 10. The yarn feeder 24 is mounted on a vertical arm 25 extending from one of the transversely elongated and opposedly arranged cam arrangement base members 21, 21.

Figure 1:
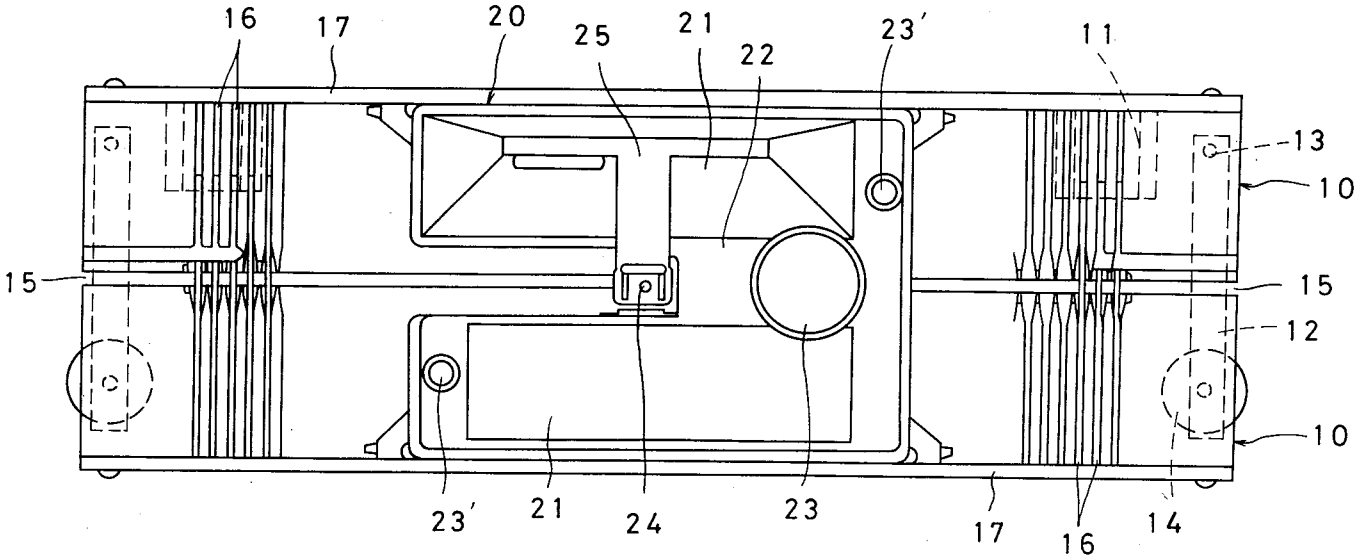
Figure 2:
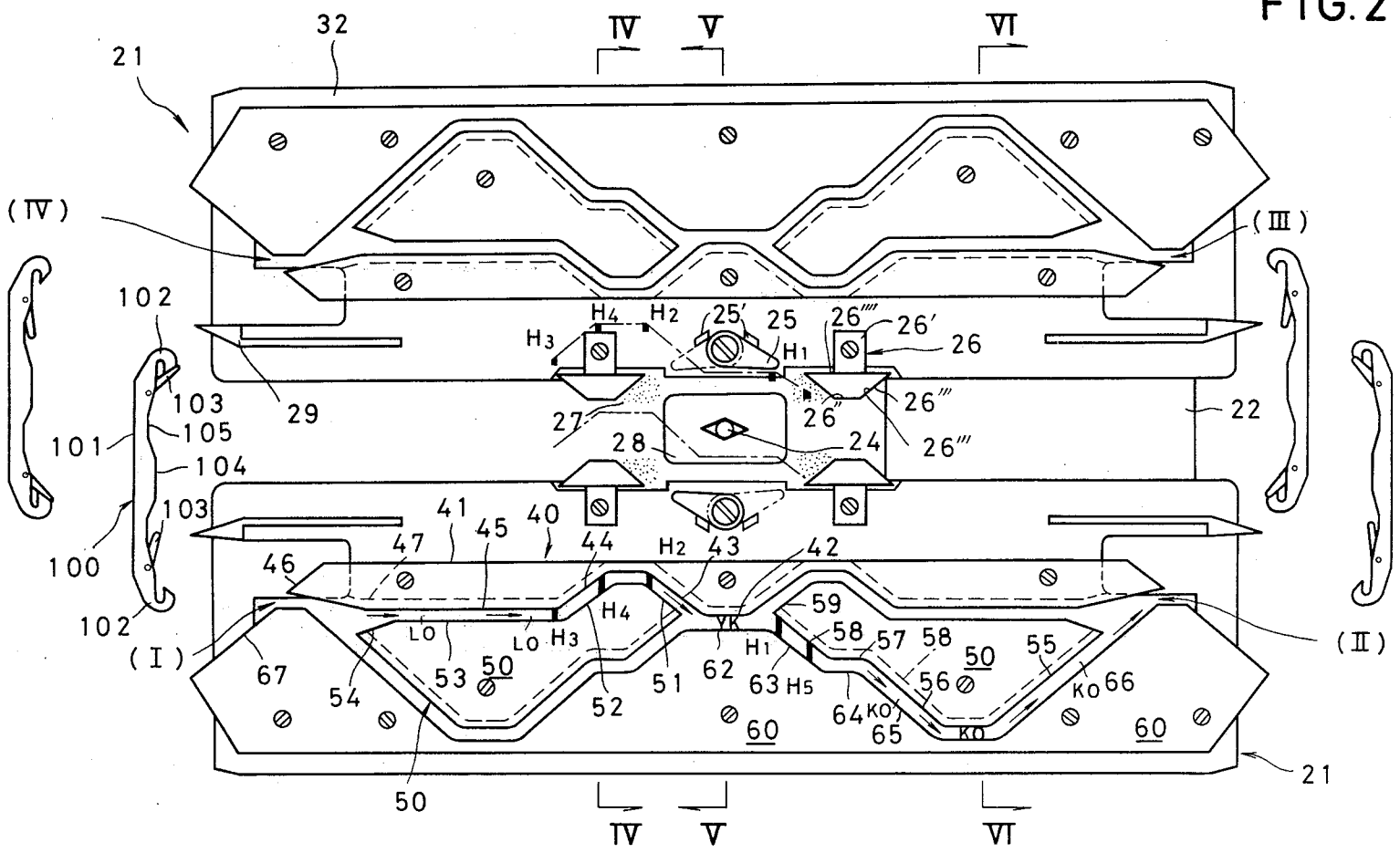

Now referring to FIG. 2 showing the reverse side of the cam carriage 20 in an enlarged scale, there is seen the yarn feeder 24 just at the center thereof. Along the both transverse outer sides of the cam carriage 20, there are provided two transversely elongated rims 32, 32 for each engaging with said guide rails 17, 17 of the needle beds for ensuring smooth transverse sliding of the carriage 20.

Arrangement of cam plates and other related members is symmetrical both vertically and transversely in respect of the center of the yarn feeder 24 as referred to above so that there are four such members or portions in principle, but exceptionally two, as readily appreciated by glancing at FIG. 2. Thus reference numerals shall be given merely to one of them for the sakes of clarity and simplicity of the drawing.

Figure 4:
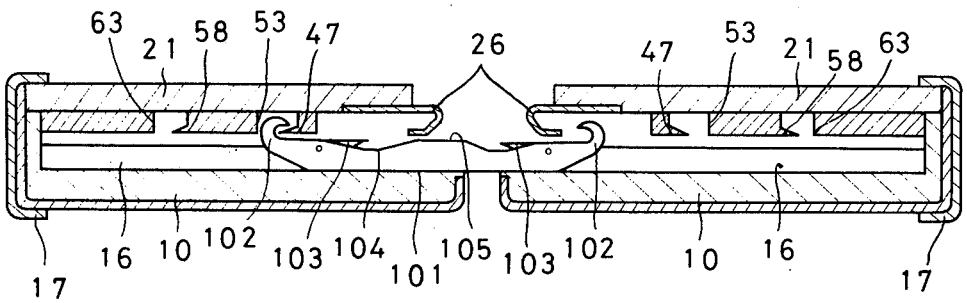
FIG. 4 is a cross-sectional view taken along the line IV—IV in FIG. 2 for showing a part of the cam carriage together with a needle lying in the corresponding needle groove as well as the needle beds.
Figure 5:
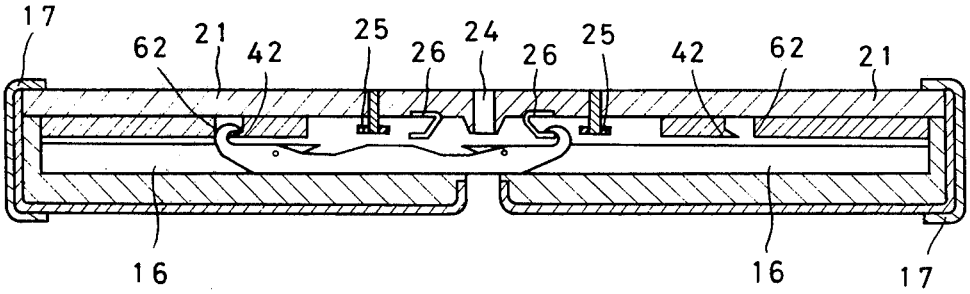
FIG. 5 is a similar view taken along the line V—V in FIG. 2.
Figure 6:
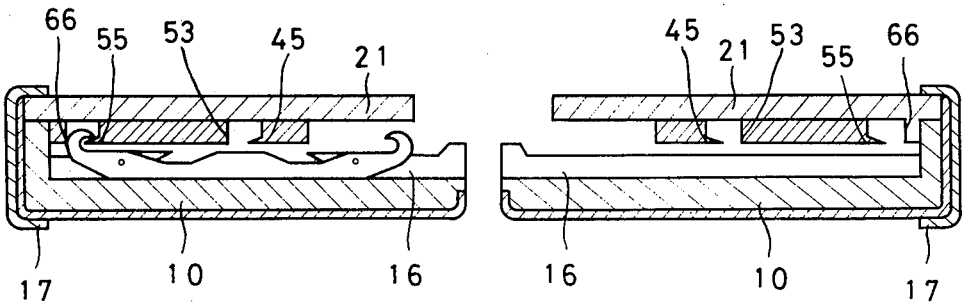
FIG. 6 is also a similar view taken along the line VI—VI in FIG. 2.

There are four entrances (I), (II), (III) and (IV) into the cam carriage 20 for a needle represented generally by 100 which has a straight back 101 to rest on bottom of the needle groove 16, two hooks 102, 102 each projecting out of the needle bed surface, two latches 103, 103 each pivotally moved between the cleared position and the hook closing position, midway protrusion 104 to be flush with the needle bed surface, and concaved portions 105, 105 formed between said midway protrusion 104 and the latch pivoting points so as to give respective clearance between the free end of the cleared latch and the upper surface of said concaved portion 105 for facilitating to bring the latch to its hook closing position. The attitude of every needle 100 as illustrated in FIG. 2 is for showing the shape and dimension thereof, and actually it must be turned by 90° in relation to the cam arrangement in said drawing so that when the hooks 102 may face thereto and either thereof may engage with the cam plate as best shown in FIGS. 4, 5 and 6.

The needles in positions (I) and (IV) are shown to be going to enter the cam carriage 20 to be moved toward the left in FIG. 2, and vice versa as to the needles in positions (II) and (III). The needles 100 in positions (I) and (II) are for knitting operation on the forward needle bed 10, for instance for making surface loop or front stitch, and so those in positions (III) and (IV) for forming back loop or back stitch on the rearward needle bed 10.

Now the cam arrangement shall be explained mainly in relation to the needle in position (I). There is provided a transversely elongated cam plate represented generally by reference numeral 40 with leaving a some distance between the yarn feeder 24 and a transverse inner or forward side 41 thereof which is made substantially straight and parallel to the cam carriage travel direction. The distance between said forward side 41 and the corresponding side of the opposedly arranged cam plate is made a little longer than the length of the needle 100 so as to form float stitches as occasion demands, by arranging some needles in the respective needle grooves 16 across the two needle beds 10, 10 so that the transverse movement of the carriage 20 does not cause any vertical movement for knitting operation of said needles.

Said elongated cam plate 40 comprises, at the midway along the transverse outer or rearward side thereof, a central cam portion of a substantially truncated triangle having a truncated vertex 42 and oblique sides 43, 43 so that when the cam engaging hook 102 of the needle 100 abuts on the angled side 43 of the left side in FIG. 2 of the cam carriage 20 moving toward the left in said drawing the needle 100 is retracted thereby, and when the needle hook 102 is brought to said truncated vertex portion 42 the opposite hook 102 of the needle 100 may face at the yarn feeder 24 for receiving yarn.

There is provided on said transverse rearward side of the cam plate 40 further a guide cam portion 44 adjacent to and at the left side of said needle retracting cam 43 so as to be substantially symmetrical therewith. There is provided further a transversely straight cam portion 45 following said guide cam 44 to extend toward the left free end of said transversely elongated cam plate 40. Said free end is pointed 46 for clearing the eventually closed latch 103 of the needle 100 entering the passage from position (I). The rearward side of the cam plate 40 is sharpened to be in a thin edge along the transverse length thereof as shown by a phantom line 47 in FIG. 2, and more clearly illustrated in FIGS. 4, 5 and 6, for ensuring engagement of the needle hook 102 with the cam plate 40.

There are provided on the cam arrangement base member 21 of the cam carriage 20 two second cam plates, which are of same configuration with each other and symmetrically arranged, represented generally by reference numerals 50, 50 so as to form a needle hook passage LO for the "latch-over" movement between the forward side of said cam plate 50 at the lefthand in FIG. 2 and the rearward side of said cam plate 40, and a needle hook passage KO for the "knock-over" movement between the rearward side of said cam plate 50 at the righthand in said drawing and the forward side of a transversely elongated cam plate to be referred to hereinafter, in relation to the needle 100 entering the cam arrangement from the position (I).

There are totally four cam plates 50 arranged symmetrically in respect of the center of the cam carriage 20, but as a matter of convenience the cam arrangement thereof shall be explained regarding the lefthand one on the rearward cam arrangement base member 21 so far as the "latch-over" passage LO is concerned, and then regarding the righthand one on the same base member in respect of the "knock-over" passage. The cam plate 50 has a guide cam portion 51 opposing to said needle retracting cam 43, a needle advancing cam portion 52 opposing to said guide cam 44, and a substantially straight cam portion 53 opposing to said straight guide cam 45, respectively with leaving a narrow space gap therebetween for the needle hook passage LO. The left end of the cam plate 50 is preferably a little curved rearwardly and pointed 54 so as to allow smooth entering of the needle hook 102 into the latch-over passage LO.

The cam arrangement of the cam plate 50 along the rearward side thereof which is to produce the "knock-over" passage KO for the needle 100 entering from position (I) with cooperation of the third cam plate to be referred to hereinafter, shall be explained regarding the righthand one. The cam plate 50 has a guide cam portion 55 rearwardly and inwardly ("inwardly" to be replaced with "outwardly" when explaining in view of the needle passing from the position (I)) slanted from the outermost pointed portion 54, which is symmetrically correspond to the pointed portion 54 having been explained with respect to the lefthand cam plate 50, an angled cam portion 56 for retracting the needle 100 having entered from the entrance (I) and slanted in such a way as to be symmetrical with said guide cam 55, a short transversely straight cam portion 57, and further an angled cam portion 58 for retracting the needle 100 from the entrance (I) so as to join with the truncated vertex 42 of the truncated triangle cam as referred to above. The innermost end of the cam 50 where the slanted cam 51 at the forward side crosses with the contrarily slanted cam 58 at the rearward side, is pointed 59. The rearward side of said cam plate 50 is also sharpened to be in a thin edge along the transverse length thereof as shown by a phantom line 58 in FIG. 2, and more clearly illustrated in FIGS. 3, 4 and 5.

There is provided further a third cam plate transversely elongated and represented generally by reference numeral 60. The rearward side or in other words the transversely outer side thereof is made straight and parallel to the cam carriage travel movement. Along the forward side of said cam plate 60, there are provided at the midway a central guide cam portion 62 opposing to the truncated vertex 42 so as to form therebetween a needle hook passage YR for receiving yarn, a slanted guide cam portion 63 opposing to the needle retracting cam 58, a short transversely straight portion 64 opposing to the short straight guide cam 57, an angled guide cam portion 65 opposing to the needle retracting cam 56, and a needle advancing cam portion 66 opposing to the guide cam 55, so as to form respectively therebetween the needle hook passage KO for the "knock-over" movement of the needle 100 from the position (I). There is provided on said cam plate 60 at each of the opposite ends thereof a forwardly and inwardly slanted edge 67 for the purpose to be referred to hereinafter.

The cam arrangement for defining the needle hook passages LO, YR and KO has been explained in respect of the needle 100 in the position (I). The hook passage of the just same configuration but arranged symmetrically for the needle 100 from the position (II) crosses with said passages LO, YR and KO so as to possess said passage YR commonly. There will be no need for further explaining on the needle hook passages for the needles 100 from the positions (II), (III) and (IV). It is only added by way of precaution that the manual driving of the cam carriage 20 toward the left in FIG. 2 for causing relative transverse movement of each of a series of needles 100 from the position (I) to the position (II) regarding said cam carriage, can result in only front stitch, and that the needles 100 having left out of the cam carriage 20 to be at the position or the exit (II) should be transposed vertically forwardly along the respective needle groove 16 whereby this time each opposite needle hook may transversely be moved from the position (IV) to the position (III) during the reverse travel of the cam carriage 20 for forming back stitch, in order to produce the typical pearl knitting. Of course, for attaining the same purpose, the needle 100 can pass the courses of from (II) to (I) and then from (III) to (IV). In order to produce any other variation of knitting, the passages of the needle can be varied as well known to those skilled in the art.

Figure 3A:
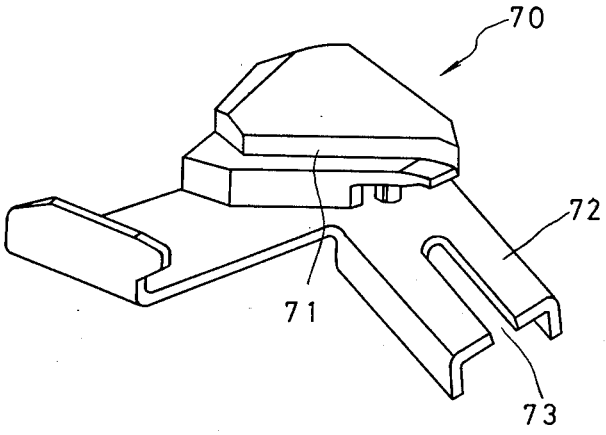
Figure 3B:
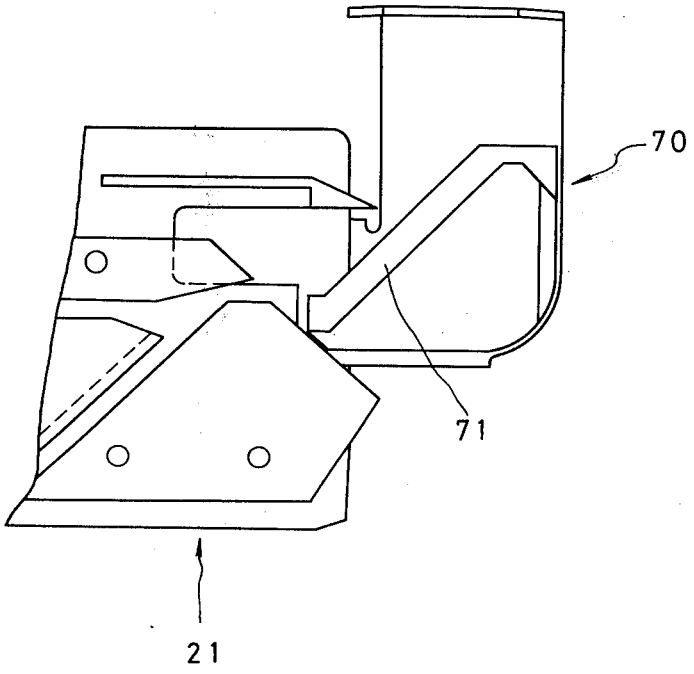

In order to move, automatically and consequently in reply to the transverse movement of the cam carriage 20 to the left in FIG. 2, the needle 100 from the position (I) and being now at the position (II) vertically and forwardly along the respective needle groove 16 to the position (III), there is provided an independent cam plate represented generally by reference numeral 70 in FIGS. 3A and 3B, which comprises a slanted cam portion 71 and a connector portion 72 having a slot 73. This cam member 70 can detachably be mounted to the cam arrangement base member 21 by inserting said connector leg portion 72 into a corresponding receptor (not shown) formed in the cam arrangement base member 21 so that the cam engaging hook 102 of the needle 100 from the position (I) which is going to leave the knock-over passage KO, is advanced by said angled cam 71 so as to bring the needle 100 to the position (III), whereby the needle 100 can be guided by the cam arrangement in the opposite cam arrangement base member 21 for carrying out the back stitch formation. In order to attain further front stitch, the same configuration cam member 70 is to be symmetrically mounted to the forward cam arrangement base member 21 so that the needle 100 to be going to leave out of the knock-over passage in the forward cam arrangement base member 21 is vertically rearwardly moved by the slanted cam 71 to the position (I). When inserting the cam member 70, the slot 73 engages with a threaded stud of the knob 23' (FIG. 1) so that when actuating the knob 3' the cam 70 is fixedly mounted on the cam carriage plate member 21.

When moving the cam carriage 20 toward the left in FIG. 2, the rearward hook 102 of the needle 100 in the position (I) goes to the right relative to the carriage in said drawing to reach at the transversely central passage YR. If there is provided no means, the needle hook 102 may eventually erroneously enter the latch-over passage for the needle 100 from the position (II). In order to avoid such misoperation and ensure for the needle hook 102 of the needle 100 from the entrance (I) to correctly enter the knock-over passage KO, there is provided, according to the invention, an angularly movable control cam lever 25 pivoted on the opposite cam arrangement base member 21 of the cam carriage reverse side so that when the cam engaging hook 102 is midway of the yarn receiving passage YR, the outer side of the opposite hook 102 for knitting operation may clear the pivoted cam lever 25 which may angularly be moved between the two positions as illustrated by a solid line and a phantom line. In order to so limit the angular movement thereof, stoppers 25, 25' are provided. In either position, the rearward side or transversely inner side, of the cam lever 25 is adapted to be substantially parallel to the carriage travel direction. When the cam engaging hook 102 having almost passed through the passage YR to reach at a position $H_1$, the opposite hook 102 at the corresponding position $H_1$ can not vertically forwardly be moved due to abutment of such hook on said cam lever 25 so that the cam engaging hook 102 can not erroneously enter the righthand latch-over passage but correctly enters the righthand knock-over passage KO from the leftmost point 59 of the second right cam plate 50. Even if the control cam lever 25 is eventually positioned as shown in the phantom line or at any other position between said two positions, the latch cleared hook 102 will forcingly bring the freely angularly movable cam lever 25 to its operative position illustrated by the solid line, as the needle 100 is retracted by passing of the cam engaging hook 102 through the passage defined by the cams 43 and 51. Of course another pivoted cam lever 25 must be symmetricallly arranged.

As referred to above, the latch 103 for knitting operation hook 102 must have been cleared not only for receiving yarn but also for bringing the cam lever 25 eventually in any not-operative angular position to the operative position illustrated by the solid line in FIG. 2, where said cam lever 25 serves to bring the needle 100 into the correct passage. The latch closed hook 102 can not bring the cam lever 25 to its operative position. For ensuring to clear the eventually closed latch 103 for the knitting operation hook 102, there is provided, according to the invention, a latch clearing cam member in such configuration and arrangement that when the cam engaging hook 102 enters the needle advancing passage defined by the cams 44, 52 the opposite hook 102 for knitting operation eventually closed by the concerned latch 103 may engaged a pointed end of said latch clearing member, and further advancing of the needle 100 due to engagement of the concerned hook 102 with said needle advancing cams 44, 52 may cause engagement of the latch 103 on the knitting operation hook side with a slanted edge of said latch clearing member to be forcingly opened.

There is provided, according to a preferred embodiment, a member 26 by bending a sheet metal to have a base portion 26' which is fixed to the opposite cam arrangement base member 21 by means of a screw, an upwardly extending portion 26'', and a forwardly upwardly extending slanted portion defined by two sides 26''' made wider toward the forward free edge 26'''' so that when the cam engaging hook 102 is at a position $H_3$ just before said needle advancing passage, the pointed outermost end, which is formed by crossing of the angled side 26''' with the forward straight edge 26'''', may face to the needle hook 102 between the slightly rearwardly bent tip thereof and the latch pivoting portion, and so that when the needle 100 is further relatively moved to the right in FIG. 2 and consequently when the cam engaging hook 102 thereof reaches at a position $H_4$ midway of the needle advancing passage defined by the cams 44, 52, the opposite hook 102 arrives at the corresponding position $H_4$ during which the concerned latch 103 is forcingly engaged with and cleared by said angled side 26'''.

It has been found preferable to provide a brush 21 planted just adjacent said latch clearing cam member 26 and further a plate 26 around the yarn feeding 24 in order to ensure the latch 102 to be kept in its open position. The plate member 28 is sufficiently one, but the latch clearing cam member 26 and the brush 27 for yieldingly keeping the shaping latch to be open must be provided in the number of four. Said four cam members 26 and brushes 27 are to be formed in the same configuration and arranged symmetrically in relation to the central yarn feeder 24. It goes without saying that the explained members 26 and 27 which are at the upper left in FIG. 2 are for the needle 100 from the entrance (I), but the upper right ones are for the needle 100 from the entrance (II), the lower right ones for the needle 100 from the entrance (III), and the lower left ones for the needle 100 from the entrance (IV).

When the cam engaging hook 102 reaches at a position $H_5$, midway the first needle retracting passage defined by the cams 58 and 63 in the knock-over passage KO, the opposite hook 102 is at the corresponding position $H_5$ where the concerned latch 103 is in its open position so that the inner pointed end of the rearward right member 26 may engage with the clearance made between the tip of the latch 103 in its open position and the surface of the concaved portion 105 of the needle 100. Further retracting of the needle 100 thus causes forcing close of the latch 103 due to abutment thereof on the slanted side 26'' of the member 26. Said latch 103 may be closed also by the yarn loop already brought on the needle shank when the needle 100 is retracted for forming stitch, but said latch clearing member 26 is necessary for ensuring to close the latch and consequently for proceeding with stitch formation on the knock-over movement of the needle without fail.

It is remembered that each free end of the third cam plate 60 is formed in the slanted edge 67. In cooperation with said inwardly forwardly angled side 67, there is provided an inwardly rearwardly slanted cam 29 on the opposite half of the cam arrangement base members 21 so that when the needle 100 to be brought into the cam arrangement with its concerned cam engaging hook 102 from the entrance (I) is not eventually correctly arranged along the concerned needle groove 26 may be guided by means of cooperation of said pair of inwardly convergent slanted cams 29, 67. Naturally the distance between the forwardmost portion of said cam 67 and the rearwardmost portion of said cam 29 is made a little longer than the length of the needle 100.

What is claimed is:

1. A hand knitting machine for pearl knitting comprising two needle beds arranged opposedly and spacedly in a horizontal plane, each of said beds having a plurality of vertical needle grooves, and a manually actuatable cam carriage having a yarn feeder at the center thereof either transversely or vertically and two cam arrangement base members to be transversely reciprocated astride and along said two beds, each of said base members having on the reverse side thereof two passages defined by a plurality of cam plates and extending along the transverse length thereof symmetrically in respect of said central yarn feeder, so that when actuating said carriage a plurality of double hook latch needles arranged respectively in said needle grooves are successively subjected to vertically forward and rearward movement along the respective needle groove according to engagement of every latch cleared hook on one side of the needle directly with any of said passages, whereby every opposite side hook may be subjected to knitting operation on the opposite needle bed and beneath the opposite cam arrangement base member, wherein the improvement lies in the cam carriage comprising;

four needle latch passages arranged symmetrical either transversely or vertically in respect of said central yarn feeder, each having an entrance, a forwardly inwardly slanted part for advancing the needle to cause "latch-over" movement, a rearwardly inwardly slanted part for retracting the needle, a central part so located that when the passage cam engaging hook of the needle lies therein the opposite hook of which concerned latch is cleared may face just at the yarn feeder for receiving yarn, a rearwardly outwardly slanted part for further retracting the needle to cause "knock-over" movement, a forwardly outwardly slanted part for advancing the needle, and an exit symmetrically positioned in relation to said entrance, said exit being to be an entrance of the other passage arranged symmetrically on the same cam arrangement base member so as to have said central part commonly and for the needles each to pass therethrough when actuating the carriage in the opposite direction;

four pairs of symmetrically arranged guide members, each provided at the outermost end of said cam arrangement base member and having inwardly convergent guide faces therebetween so as to bring the passage cam engaging hook of the needle eventually not in the vertically correct position in the concerned needle groove correctly to said passage entrance;

four symmetrically arranged members for clearing the needle latch on the passage cam engaging hook side, each having a transversely outwardly pointed portion and provided at the concerned passage entrance so as to clear the eventually closed latch; and two symmetrically arranged pivoted arm members, each pivoted between said yarn feeder and said yarn receiving central part of the passage so as to be freely angularly moved by substantially 180° between the two positions in either of which the inner side of the transversely elongated arm is substantially parallel to the carriage travel direction, whereby when said arm member is in its operative position in which the arm member extends in the direction opposite to the carriage travel, the inner side of said arm member abuts on the knitting operation hook so as to correctly guide the passage cam engaging hook from the central yarn receiving passage part into the rearwardly outwardly slanted passage part for retracting the needle and causing the "knock-over" movement.

2. The hand knitting machine as claimed in claim 1 of which cam carriage further comprises;

four symmetrically arranged members for clearing the needle latch on the knitting operation hook side, each having two opposite transversely pointed portions so that when the passage cam engaging hook passes through said forwardly inwardly slanted passage part, the opposite hook may firstly engage with the outwardly directed one of said two transversely pointed portions and further forward movement of said hook may then cause forcing clear of the eventually closed latch, the other pointed portion of the corresponding member in the symmetrical position serving also to close the latch eventually still in its open position on the knitting operation hook side when the opposite hook passes through said rearwardly outwardly slanted passage part;

four symmetrically arranged yieldable members for keeping the needle latch on the stitch formation hook side in its open position, each provided closely adjacent to and transversely inner side of the latch clearing member just referred to above so that when the passage cam engaging hook passes through the rearwardly inwardly slanted passage part, the cleared latch of the opposite hook abuts on said yieldable member to be kept in its open position; and a plate member provided around said yarn feeder so as to abut on the cleared latch of the knitting operation hook in order to keep the latch in its open position.

3. The cam carriage of the hand knitting machine as claimed in claim 1, which further comprises a pair of independent cam members, each having a leg portion and a forwardly outwardly slanted cam portion, and adapted to be detachably mounted to the cam arrangement base member at the passage exit by inserting said leg portion into a corresponding receptor fixedly mounted on said base member so as to advance the needles successively leaving out of said passage exit along said slanted cam portion toward the passage entrance of the opposed cam arrangement base member.

4. The cam carriage of the hand knitting machine as claimed in claim 1, in which said pair of guide members are produced on one hand by a forwardly inwardly slanted cam formed at the outermost end of cam plate defining the concerned passage entrance and on the other hand by a separate cam member having the opposdely slanted cam portion and provided on the opposite cam arrangement base member so that the shortest distance between said inwardly convergent two cam members is slightly longer than the length of the needle.

5. The cam carriage of the hand knitting machine as claimed in claim 4, in which said member for clearing the needle latch on the passage cam engaging hook side is produced by a transversely outwardly pointed portion formed at the outermost end of another cam plate which defines the concerned passage entrance in cooperation with said cam plate referred to in claim 4.

6. The cam carriage of the hand knitting machine as claimed in claim 1, in which said pivoted arm member is so located in relation to said rearwardly inwardly slanted passage part that even when said freely angularly movable arm is in any angular position other than its operative position, the knitting operation hook of which concerned latch is cleared may engage said arm member to be brought into said operative position as the needle is retracted by passing of the passage cam engaging hook through said passage part.

7. The cam carriage of the hand knitting machine as claimed in claim 2, in which said member for clearing the needle latch on the knitting operation hook side is produced by bending a sheet metal to have a base portion fixedly mounted to the cam arrangement base member, a perpendicularly extending portion, and a rearwardly slanted flat face portion defined by a free transversely straight edge and two sides each made wider toward the free edge for forming respectively transversely pointed two opposite portions, and so located in relation to said forwardly inwardly slanted passage part on the opposite cam carriage base member and said rearwardly outwardly slanted passage part on the same cam carriage base member that the knitting operation hook eventually closed with the concerned latch may engage with said transversely pointed and outwardly directed portion and said slanted side as well as said slanted flat face may serve to smoothly bring the latch to its cleared position in reply to the needle advancing movement and that the latch in its cleared position of the knitting operation hook may engage said transversely pointed and inwardly directed portion and said slanted side as well as said slanted flat face may serve to smoothly bring the latch to its closed position in reply to the needle retracting movement.

8. The cam carriage of the hand knitting machine as claimed in claim 2, in which said yieldable member is a brush planted on the cam carriage base member and so located in relation to said rearwardly inwardly slanted passage part on the opposite base member that the cleared latch may abut on said yieldable brush to be kept in its open position during the needle is being retracted with the passage cam engaging hook entering said rearwardly inwardly slanted passage part.

* * * * *